US010819058B2

(12) United States Patent
Yudate

(10) Patent No.: US 10,819,058 B2
(45) Date of Patent: Oct. 27, 2020

(54) CONTACT CONNECTION STRUCTURE WITH AN INDENT PORTION

(71) Applicant: Yazaki Corporation, Tokyo (JP)

(72) Inventor: Takahiro Yudate, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/406,127

(22) Filed: May 8, 2019

(65) Prior Publication Data

US 2019/0348789 A1 Nov. 14, 2019

(30) Foreign Application Priority Data

May 11, 2018 (JP) ..... 2018-091954

(51) Int. Cl.

| | |
|---|---|
| ***H01R 4/10*** | (2006.01) |
| ***H01R 9/24*** | (2006.01) |
| ***H01R 13/02*** | (2006.01) |
| ***H01R 13/422*** | (2006.01) |
| ***H01R 13/03*** | (2006.01) |
| ***H01R 13/05*** | (2006.01) |
| ***H01R 13/11*** | (2006.01) |

(52) U.S. Cl.

CPC ..... *H01R 13/4223* (2013.01); *H01R 13/03* (2013.01); *H01R 13/05* (2013.01); *H01R 13/11* (2013.01)

(58) Field of Classification Search

CPC ..... H01R 13/03; H01R 13/04; H01R 13/11
USPC ..... 439/877, 884
See application file for complete search history.

(56) References Cited

U.S. PATENT DOCUMENTS

| | | | | |
|---|---|---|---|---|
| 9,871,311 | B2 * | 1/2018 | Fukui | H01R 13/14 |
| 2014/0248809 | A1 * | 9/2014 | Onodera | H01R 13/03 439/884 |
| 2015/0236439 | A1 | 8/2015 | Okubo et al. | |
| 2016/0013567 | A1 * | 1/2016 | Sakaguchi | H01R 4/188 439/877 |
| 2016/0276768 | A1 | 9/2016 | Sunaga et al. | |
| 2016/0365648 | A1 * | 12/2016 | Aoki | H01B 1/026 |
| 2018/0245230 | A1 | 8/2018 | Sonoda et al. | |

(Continued)

FOREIGN PATENT DOCUMENTS

| | | | |
|---|---|---|---|
| CN | 107923058 | A | 4/2018 |
| JP | 04154987 | A | 5/1992 |
| JP | 11-214115 | A | 8/1998 |

(Continued)

*Primary Examiner* — Abdullah A Riyami
*Assistant Examiner* — Thang H Nguyen
(74) *Attorney, Agent, or Firm* — Sughrue Mion, PLLC

(57) ABSTRACT

A contact connection structure includes: a first contact part provided in a first terminal, having a first plating layer formed on an outer surface of a first base material, and having an indent portion protruding from a plane formed by the outer surface of the first base material; and a second contact part provided in a second terminal, having a second plating layer formed on an outer surface of a second base material, and configured to be in contact with the indent portion. At least one of the outer surface of the first base material at the first contact part and the outer surface of the second base material at the second contact part is formed as a smooth surface with smaller surface roughness than surface roughness of a rolled bar material.

10 Claims, 5 Drawing Sheets

(56) References Cited

U.S. PATENT DOCUMENTS

2018/0371633 A1* 12/2018 Tsuru ..... C25D 3/58

FOREIGN PATENT DOCUMENTS

| | | | | | |
|---|---|---|---|---|---|
| JP | 2007-280825 | A | | 10/2007 | |
| JP | 2011-124141 | A | | 6/2011 | |
| JP | 2014022537 | A | | 2/2014 | |
| JP | 2015-41441 | A | | 3/2015 | |
| JP | 2015041441 | | * | 3/2015 | ..... H01R 13/03 |
| JP | 2017-162598 | A | | 9/2017 | |
| WO | 2015083547 | A1 | | 6/2015 | |

* cited by examiner

CONTACT CONNECTION STRUCTURE WITH AN INDENT PORTION

CROSS REFERENCE TO RELATED APPLICATION

This application is based upon and claims the benefit of priority from the prior Japanese Patent Application No. 2018-091954, filed on May 11, 2018, the entire contents of which are incorporated herein by reference.

BACKGROUND

Technical Field

The disclosure relates to a contact connection structure that makes electrical connection between a first terminal and a second terminal.

Related Art

As a female terminal and a male terminal to Which a conventional contact connection structure is applied, there is known a structure in which the female terminal has a square box part and an elastically flexible part that is provided integrally with the box part and is arranged in the box part (refer to JP 2017-162598 A and JP 2007-280825 A for related techniques). The elastically flexible part is provided with an indent portion protruding toward the bottom surface. The indent portion has an outer peripheral surface in an almost spherical cap shape and a central vertex of the outer peripheral surface located at the lowermost position.

The female terminal is furnished with plating from the viewpoints of improving connection reliability in high-temperature environments, improving corrosion resistance in corrosion environments, and others.

The male terminal in such a conventional contact connection structure has a tab portion in a flat-plate shape. The male terminal is furnished with plating from the viewpoints of improving connection reliability in high-temperature environments, improving corrosion resistance in corrosion environments, and others.

In the foregoing configuration, when the tab portion of the male terminal is inserted into the box part of the female terminal, the elastically flexible part flexibly deforms to upper surface side to permit insertion of the tab portion. In the process of insertion of the tab portion, the tab portion slides over the indent portion of the elastically flexible part. At the terminal insertion completed position, the indent portion of the elastically flexible part and the tab portion are in surface contact with each other.

With the restoring force of the elastically flexible part as a contact load, the contact surfaces of the indent portion of the female terminal and the tab portion of the male terminal come into electrical contact with each other. Electric current flows through the contact surfaces to flow electrical current between the female terminal and the male terminal.

Base materials for the female terminal and the male terminal are rolled bar materials of a copper alloy or the like. Accordingly; unevenness due to rolling scratches is formed on the outer surface of the base material of each terminal. The plating layer on each of the terminals is formed as uneven surface following the uneven surface of the base material.

Therefore, the contact surfaces of the female terminal and the male terminal (for example, the contact surfaces of the indent portion and the tab portion) have an actual conduction area that is smaller than an apparent contact area, which leads to large contact resistance. To reduce contact resistance, the contact load between the contact parts may be increased. In this case, however, the contact connection structure will have the female terminal and the male terminal increased in size and complexity.

SUMMARY

An of object of the present invention is to provide a contact connection structure that allows decrease in contact resistance without upsizing or complicating terminals as much as possible.

A contact connection structure according to an embodiment of the present invention includes: a first contact part provided in a first terminal and having a first plating layer formed on an outer surface of a first base material; and a second contact part provided in a second terminal to be connected to the first terminal and having a second plating layer formed on an outer surface of a second base material. The first contact part has an indent portion protruding from a plane formed by the outer surface of the first base material. In the contact connection structure, the indent portion slides on a contact surface of the second contact part in the process of terminal insertion, and the indent portion is in contact with the contact surface of the second contact part at a terminal insertion completed position. At least one of the outer surface of the first base material at the first contact part and the outer surface of the second base material at the second contact part is formed as a smooth surface with smaller surface roughness than surface roughness of a rolled bar material.

According to the above configuration, the terminals are in contact with each other by a conduction area almost equal to an apparent contact area, and it is thus possible to reduce contact resistance without upsizing or complicating the terminals as much as possible.

DETAILED DESCRIPTION

Figure 1A:
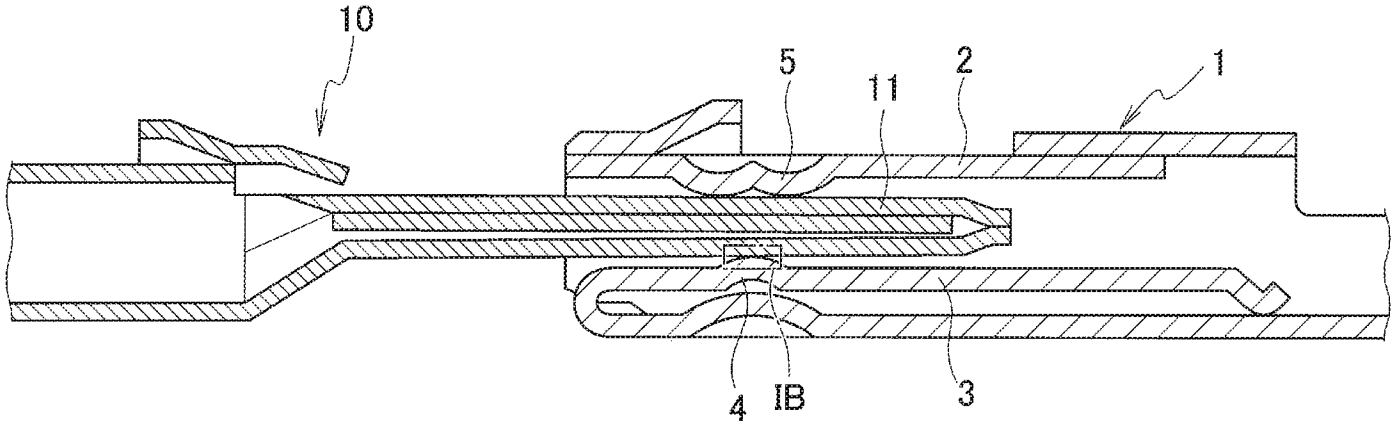
FIG. 1A is a cross-sectional view of a female terminal and a male terminal in a terminal insertion completed state according to a first embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Hereinafter, embodiments of the present invention will be described with reference to the drawings.

First Embodiment

FIGS. 1A to 5 illustrate a first embodiment of the present invention. A contact connection structure according to the present invention is applied to a female terminal as a first terminal and a male terminal as a second terminal. Hereinafter, the first embodiment will be described.

A female terminal 1 is arranged in a terminal container chamber in a female-side connector housing (not illustrated). The female terminal 1 is formed by punching out a conductive metal (for example, copper alloy) into a predetermined shape and folding the same. The female terminal 1 has a box part 2 as a first contact part. The box part 2 is in the shape of a square opened at the front side. In the box part 2, an elastically flexible part 3 is arranged by folding a lower surface portion of the box part 2 (as seen in the vertical direction of FIGS. 1A and 1B). The elastically flexible part 3 has an indent portion 4 formed by indentation processing (embossing in a spherical cap shape). The indent portion 4 protrudes toward the upper surface of the box part 2, and has an outer peripheral surface protruding toward the upper surface in an almost spherical cap shape. A center of the outer peripheral surface constitutes a vertex of the spherical cap shape. The indent portion 4 can shift downward by flexible deformation of the elastically flexible part 3. When the indent portion 4 shifts downward by the flexible deformation of the elastically flexible part 3, the vertex of the outer peripheral surface of the indent portion 4 is located at the uppermost position in the box part 2. The upper surface portion of the box part 2 has a bead portion 5 protruding toward the bottom surface of the box part 2. The bead portion 5 is arranged at a position opposed to the indent portion 4. A male terminal 10 is inserted between the elastically flexible part 3 and the bead portion 5.

The male terminal 10 is arranged in a terminal container chamber in a male-side connector housing (not illustrated). The male terminal 10 is formed by punching out a conductive metal (for example, copper alloy) into a predetermined shape and folding the same. The male terminal 10 has a tab part 11 as a second contact part. The tab part 11 has a straight plate-like outer shape.

Figure 1B:
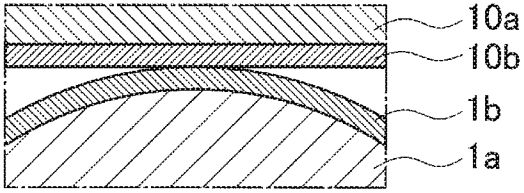
FIG. 1B is an enlarged view of a IB portion in FIG. 1A.

As illustrated in FIG. 1B, particularly, the female terminal 1 and the male terminal 10 are respectively formed from base materials 1*a* and 10*a* of a conductive metal such as a copper alloy and plating layers 1*b* and 10*b* of a conductive metal covering outer surfaces of the base materials 1*a* and 10*a*. Specifically, the plating layers 1*b* and 10*b* are respectively formed on the surfaces of the indent portion 4 and the tab part 11 opposed to and contacting with each other. Each of the base materials 1*a* and 10*a* of the female terminal 1 and the male terminal 10 is a rolled and processed bar material. Specifically, the rolled bar materials are subjected to polishing or the like such that unevenness caused by rolling scratches are smoothed out. The plating layers 1*b* and 10*b* of a conductive metal are formed on the smooth outer surfaces of the base materials 1*a* and 10*a*.

Figure 2A:
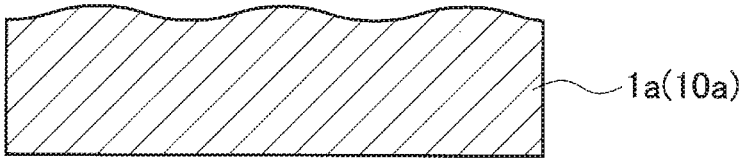
FIG. 2A is a cross-sectional view of a base material in the first embodiment of the present invention.
Figure 2B:
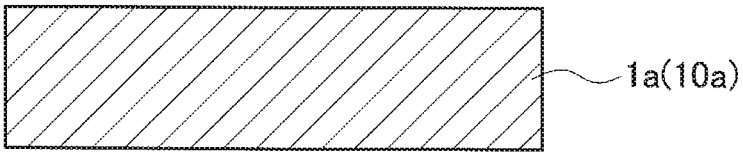
FIG. 2B is a cross-sectional view of the base material after surface polishing in the first embodiment of the present invention.

A procedure for manufacturing the female terminal 1 and the male terminal 10 will be described. As illustrated in FIG. 2A, the respective base materials 1*a* and 10*a* of the female terminal 1 and the male terminal 10 are formed from rolled bar materials (base material forming step). Next, the outer surfaces of the base materials 1*a* and 10*a* are subjected to mechanical polishing (smoothing step). Accordingly, as illustrated in FIG. 2B, the outer surfaces of the base materials 1*a* and 10*a* corresponding to at least the box part 2 of the female terminal 1 and at least the tab part 11 of the male terminal 10 are smoothed out. Next, the base materials 1*a* and 10*a* of the female terminal 1 and the male terminal 10 are punched out into predetermined shapes and folded in predetermined shapes to form the female terminal 1 and the male terminal 10 of only the base materials 1*a* and 10*a* (pressing step).

Figure 2C:
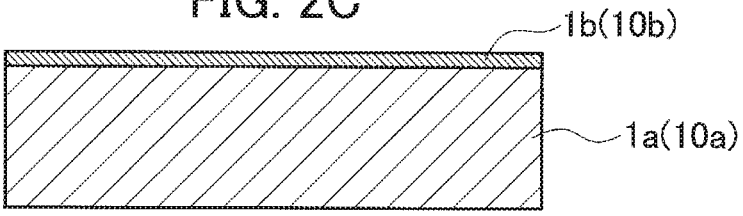
FIG. 2C is a cross-sectional view of the base material after application of plating to an outer surface in the first embodiment of the present invention.

Next, the outer surfaces of the base materials 1*a* and 10*a* are subjected to plating processing to form the plating layers 1*b* and 10*b* as illustrated in FIG. 2C (plating step). The surfaces of the plating layers 1*b* and 10*b* are smoothed out according to the outer surface shapes of the base materials 1*a* and 10*a*. The pressing step may be performed after the plating step.

In the foregoing configuration, when the female-side connector housing (not illustrated) and the male-side connector housing (not illustrated) are fitted to each other, the tab part 11 of the male terminal 10 is inserted into the box part 2 of the female terminal 1 in the process of fitting. Accordingly, first, a leading end of the tab part 11 comes into abutment with the elastically flexible part 3, and when the insertion further proceeds beyond the abutment portion, the elastically flexible part 3 flexibly deforms to allow the insertion of the tab part 11. In the process of insertion of the tab part 11 (the process of terminal insertion), the indent portion 4 and the bead portion 5 of the elastically flexible part 3 slide over the contact surface, the surface where the plating layer 10*b* is formed, of the tab part 11. At a terminal insertion completed position (connector fitting completed position), as illustrated in FIG. 1A, the indent portion 4 and the bead portion 5 come the tab part 11 with restoring force of the elastically flexible part 3 as a contact load.

As illustrated above, the outer surfaces of the base materials 1*a* and 10*a*, corresponding to the indent portion 4 and the head portion 5 of the box part 2 and the tab part 11, are formed as smooth surfaces with smaller surface roughness than surfaces roughness of the rolled bar materials. Accordingly; the surfaces of the plating layer 1*b* and 10*b* formed on the outer surfaces are formed as smooth surfaces in the same manner. As a result, the contact surfaces of the base materials 1*a* and 10*a*, corresponding to the indent portion 4 and the bead portion 5 of the box part 2 and the tab part 11, are in contact with each other by a conduction area almost equal to an apparent contact area. This makes it possible to reduce contact resistance without upsizing or complicating the terminals as much as possible.

Figure 3:
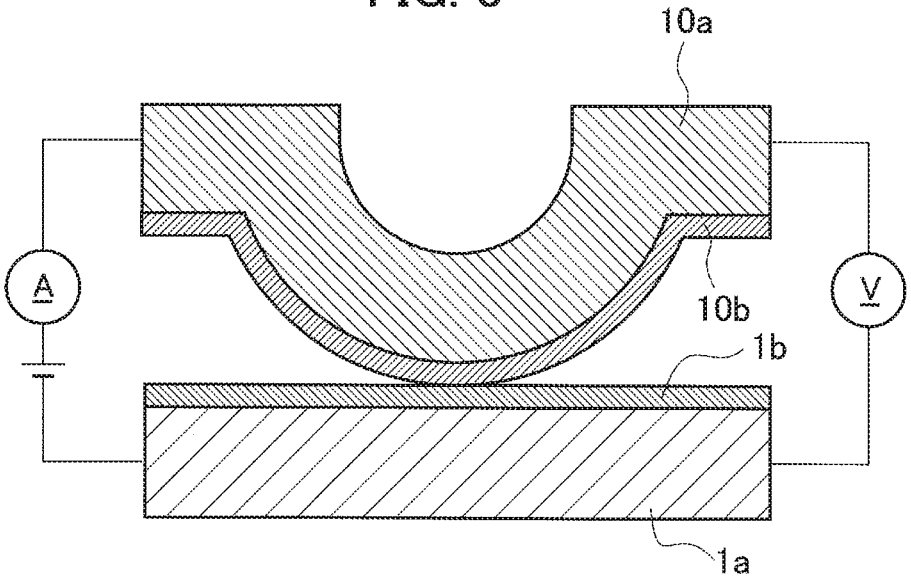
FIG. 3 is a schematic diagram of an experiment of measuring contact load and contact resistance in the first embodiment of the present invention.

Next, descriptions will be given as to results of an experiment by which contact load and contact resistance were measured on the non-processed uneven outer surfaces of the rolled bar materials as the base materials 1*a* and 10*a* and on the outer surfaces of the rolled bar materials smoothed out by mechanical polishing or the like. As conditions for the experiment, as illustrated in FIG. 3, a member (sample) assumed as the indent portion 4 and a member (sample) assumed as the tab part 11 were prepared, and the contact resistance between the member assumed as the indent portion 4 and the member assumed as the tab part 11 was measured under various contact loads.

Figure 4:
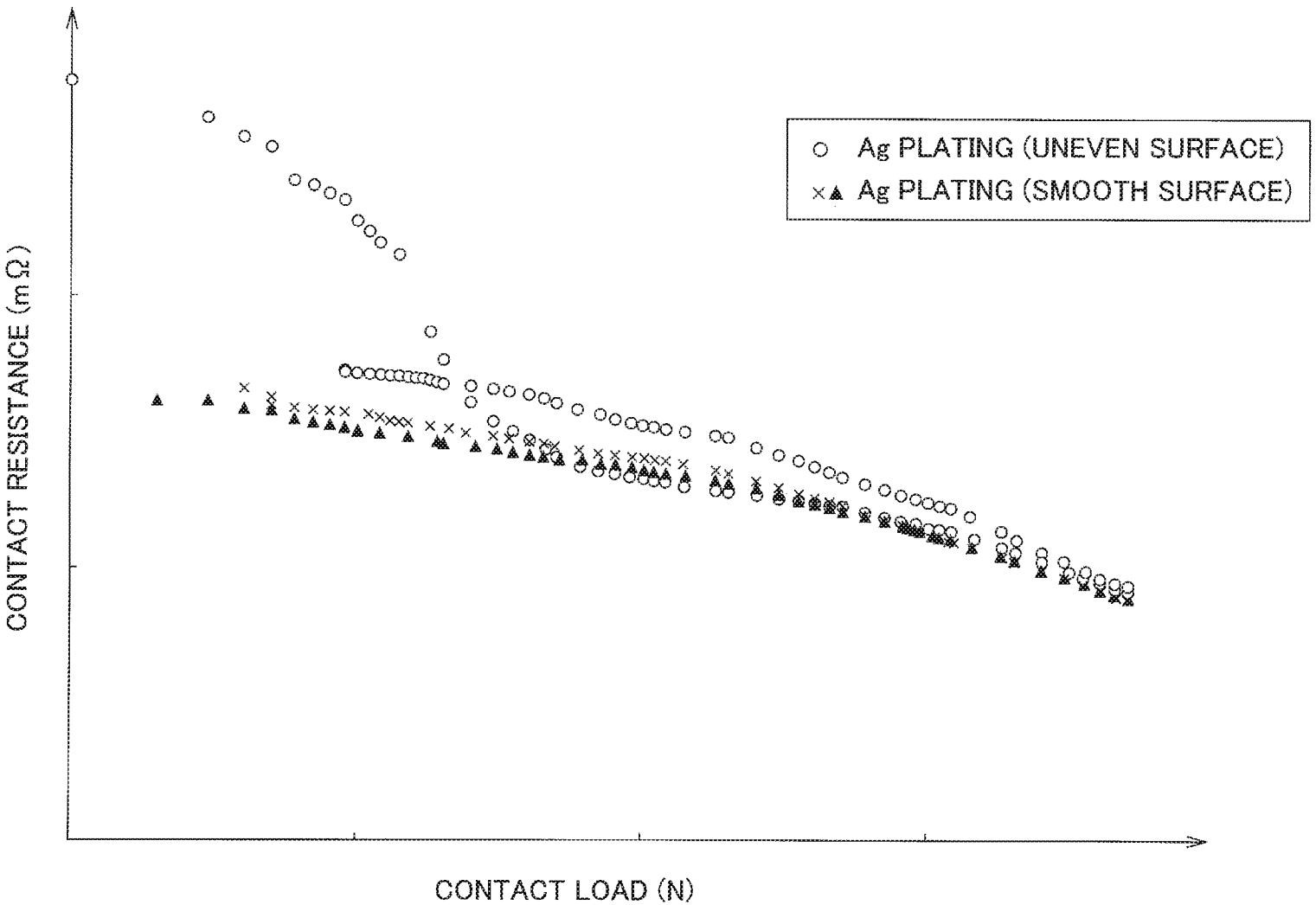
FIG. 4 is a diagram illustrating measurement results of contact resistance against contact load acting on a silver plating layer in the first embodiment of the present invention.

FIG. 4 illustrates the results of the experiment in which the plating layers 1*b* and 10*b* are silver (Ag) plating layers (noble metal plating layers). As illustrated in FIG. 4, it has been found that, in most of the ranges of the applied contact loads, the contact resistance was more stably decreased on the samples formed by the base materials 1*a* and 10*a* with the smooth surfaces than on the samples formed by the base materials 1*a* and 10*a* with the uneven outer surfaces.

FIG. 4 illustrates the results of the experiment of two each samples (total four samples) formed by the base materials 1*a* and 10*a* with the smooth surfaces and formed by the base materials 1*a* and 10*a* with the uneven outer surfaces. In the two samples with the uneven outer surfaces, the values of contact resistance were greatly different in the range of small contact loads. This is possibly because the uneven surfaces of the two materials contacted in an engaged state in some case and the uneven surfaces of the two materials contacted in a non-engaged state in the other case. In any case, it has been found that the uneven outer surfaces of the base materials 1*a* and 10*a* did not stably decrease contact resistance under small contact loads.

Figure 5:
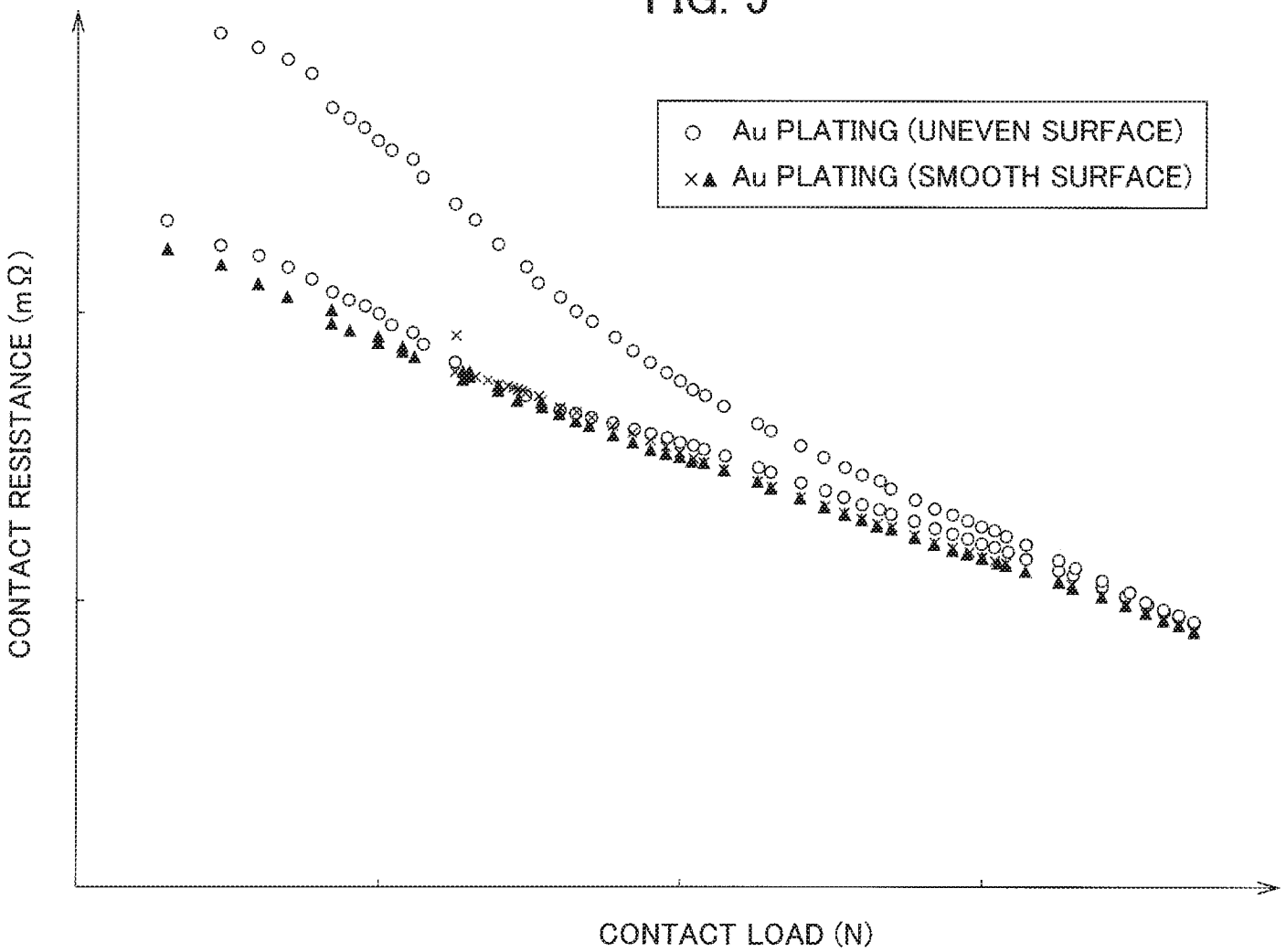
FIG. 5 is a diagram illustrating measurement results of contact resistance against contact load acting on a gold plating layer in the first embodiment of the present invention.

FIG. 5 illustrates the results of experiment in which the plating layers 1*b* and 10*b* are gold (Au) plating layers (noble metal plating layers). As illustrated in FIG. 5, it has been found that, in most of the regions of the applied contact loads, the contact resistance was more stably decreased on the samples with the smooth outer surfaces of the base materials 1*a* and 10*a* than on the samples with the uneven outer surfaces of the base materials 1*a* and 10*a*.

As with FIG. 4, FIG. 5 illustrates the results of the experiment of two each samples (total four samples) of the smooth outer surfaces of the base materials 1*a* and 10*a* and the uneven outer surfaces of the base materials 1*a* and 10*a*. In the two samples with the uneven outer surfaces of the base materials 1*a* and 10*a*, most of the values of contact resistance were greatly different. This is possibly because the uneven surfaces of the two materials contacted in an engaged state in some case and the uneven surfaces of the two materials contacted in a non-engaged state in the other case. In any case, it has been found that the uneven outer surfaces of the base materials 1*a* and 10*a* did not stably decrease contact resistance in the range of small contact loads.

The plating layers 1*b* and 10*b* are formed from a material of silver (Ag) as a noble metal in the case of FIG. 4, and are formed from a material of gold (Au) as a noble metal in the case of FIG. 5. Alternatively, these plating layers may be formed from a material of tin (Sn). However, since a material of tin (Sn) has a low melting point, even when the base materials 1*a* and 10*a* have uneven surfaces, the surfaces of the tin plating layers are likely to be flat. However, since a material of silver (Ag) and a material of gold (Au) as noble metals have high melting points, when the base materials 1*a* and 10*a* have uneven surfaces, in the noble metal plating layer, the surfaces of the silver plating layer and the gold plating layer are less likely to be flat. Therefore, the present embodiment is effective in the case of a noble metal material with a high melting point such as a silver (Ag) material or a gold (Au) material.

In the first embodiment, all the base materials 1*a* and 10*a* of the indent portion 4, the bead portion 5, and the tab part 11 are formed to have smooth surfaces with smaller surface roughness than surface roughness of the rolled bar materials. Alternatively, the base materials 1*a* and 10*a* of any one or more of these portions may be formed to have smooth surfaces with small surface roughness. For example, only the indent portion 4, only the bead portion 5, only the tab part 11, or only the indent portion 4 and the bead portion 5 may be formed to have smooth surfaces with small surface roughness.

Second Embodiment

Figure 6A:
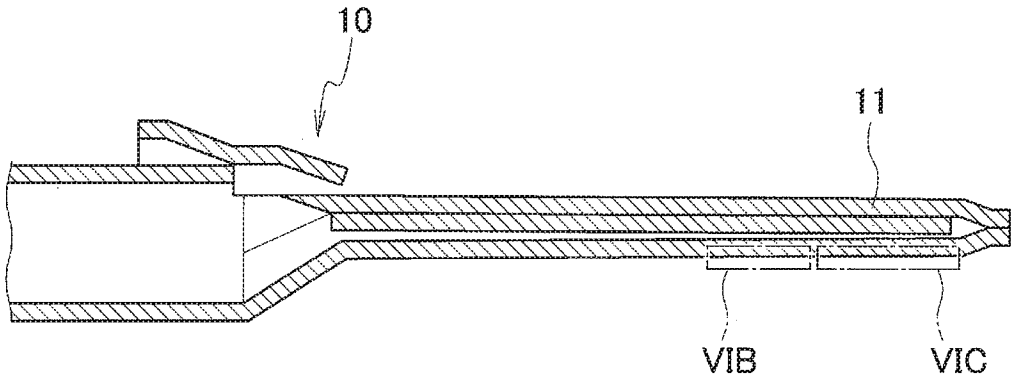
FIG. 6A is a cross-sectional view of a female terminal and a male terminal in a terminal insertion completed state according to a second embodiment of the present invention.
Figure 6B:
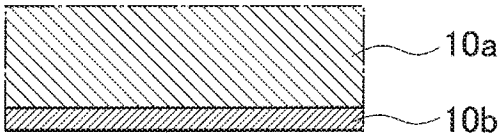
FIG. 6B is an enlarged view of a VIB portion in FIG. 6A in the second embodiment of the present invention.
Figure 6C:
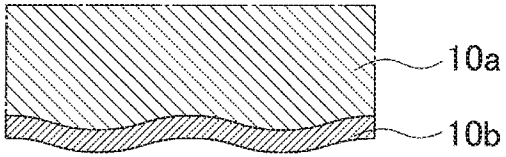
FIG. 6C is an enlarged view of a VIC portion in FIG. 6A in the second embodiment of the present invention.

FIGS. 6A to 6C illustrate a second embodiment of the present invention. A contact connection structure according to the present invention is applied between a female terminal (not illustrated) as a first terminal and a male terminal 10 as a second terminal.

The second embodiment is different from the first embodiment in that an outer surface of a base material 10*a* of the male terminal 10 is formed as a surface (illustrated in FIG. 6C) with surface roughness of a rolled bar material at a position VIC in front of a terminal insertion completed position VIB (see FIG. 6A) where an indent portion (not illustrated) is in contact. That is, the outer surface of the base material 10*a* is formed as uneven surface, and according to this, the surface of the plating layer 10*b* is also formed as uneven surface. In the region other than described above of the male terminal 10, as illustrated in FIG. 6B, the outer surface of the base material 10*a* is formed as smooth surface, and according to this, the surface of the plating layer 10*b* is also formed as smooth surface as in the first embodiment.

A configuration of a female terminal (not illustrated) is the same as that in the first embodiment, and thus description thereof will be omitted.

In the second embodiment as well as in the first embodiment, the male terminal 10 and the female terminal (not illustrated) are in contact with each other at the terminal insertion completed position by a conduction area almost equal to an apparent contact area, and it is thus possible to reduce contact resistance without upsizing or complicating the terminals as much as possible.

The outer surface of the base material 10*a* of the male terminal 10 has the surface roughness of the rolled bar material at the position in front of the terminal insertion completed position where the indent portion (not illustrated) is in contact. According to this configuration, the slide area is decreased in the first half of the process of terminal insertion to reduce the force of insertion.

As a modification example of the second embodiment, out of the outer surface of the base material 10*a* of the male terminal 10, both or either one of the surface in contact with the indent portion (not illustrated) and the surface in contact with a bead portion (not illustrated) may be formed to have the surface roughness of the rolled bar material at the position in front of the terminal insertion completed position where the indent portion (not illustrated) is in contact.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which conic within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A contact connection structure comprising:

a first contact part provided in a first terminal and having a first plating layer formed on an outer surface of a first base material; and a second contact part provided in a second terminal to be connected to the first terminal and having a second plating layer formed on an outer surface of a second base material, wherein the first contact part has an indent portion protruding from a plane formed by the outer surface of the first base material, the indent portion slides on a contact surface of the second contact part in a process of terminal insertion, and the indent portion is in contact with the contact surface of the second contact part at a terminal insertion completed position, and the outer surface of the first base material at the first contact part and the outer surface of the second base material at the second contact part are both formed as a smooth surface by being subjected to polishing such that they both respectively have a smaller surface roughness than prior to their polishing.

2. The contact connection structure according to claim 1, wherein the first plating layer and the second plating layer are noble metal plating layers.

3. The contact connection structure according to claim 1, wherein the outer surface of the second base material at the second contact part at a position in front of the terminal insertion completed position where the indent portion is in contact is not subjected to the polishing.

4. The contact connection structure according to claim 2, wherein the noble metal plating layers are independently formed from at least one material selected from the group consisting of gold (Au) and silver (Ag).

5. A contact connection structure comprising:

a first contact part provided in a first terminal and having a first plating layer formed on an outer surface of a first base material; and a second contact part provided in a second terminal to be connected to the first terminal and having a second plating layer formed on an outer surface of a second base material, wherein the first contact part has an indent portion protruding from a plane formed by the outer surface of the first base material, the indent portion slides on a contact surface of the second contact part in a process of terminal insertion, and the indent portion is in contact with the contact surface of the second contact part at a terminal insertion completed position, a first portion of the indent at the terminal insertion completed position has a surface roughness lower than a surface roughness of a second portion of the indent at the terminal insertion completed position, and wherein the first portion of the indent at the terminal insertion completed portion is closer to the start of the process of terminal insertion than the second portion of the indent at the terminal insertion completed portion.

6. The contact connection structure according to claim 5, wherein the lower surface roughness of the first portion of the indent at the terminal insertion completed position is obtained by being subject to polishing, while the second portion of the indent at the terminal completed position has not been subjected to polishing.

7. The contact connection structure according to claim 1, wherein the polishing is mechanical polishing.

8. The contact connection structure according to claim 6, wherein the polishing is mechanical polishing.

9. The contact connection structure according to claim 5, wherein the first plating layer and the second plating layer are noble metal plating layers.

10. The contact connection structure according to claim 5, wherein the noble metal plating layers are independently formed from at least one material selected from the group consisting of gold (Au) and silver (Ag).

* * * * *